US005561915A

United States Patent [19]

Vandergriff

[11] Patent Number: 5,561,915

[45] Date of Patent: Oct. 8, 1996

[54] STORAGE CONTAINER WITH SEALED STORAGE COMPARTMENT FOR A PURGING GAS CARTRIDGE

[76] Inventor: Johnie B. Vandergriff, 1855 Romand Dr., Monroe, Mich. 48161

[21] Appl. No.: 501,727

[22] Filed: Jul. 12, 1995

[51] Int. Cl.[6] ..... F26B 19/00

[52] U.S. Cl. ..... 34/201; 34/202; 34/218; 34/235; 206/3; 206/213.1; 141/10; 141/67; 141/329

[58] Field of Search ..... 34/72, 79, 201, 34/202, 218, 235; 206/3, 213.1, 524.4; 141/10, 67, 325, 329

[56] References Cited

U.S. PATENT DOCUMENTS

| | | | |
|---|---|---|---|
| 3,373,918 | 3/1968 | Krings | 206/3 |
| 3,633,381 | 1/1972 | Haaf et al. | 62/222 |
| 3,922,878 | 12/1975 | Jalali | 62/384 |
| 4,259,184 | 3/1981 | D'Arnal | 141/329 X |
| 4,532,997 | 8/1985 | Atherton et al. | 206/3 X |
| 4,606,195 | 8/1986 | Winkler | 62/45 |
| 4,761,969 | 8/1988 | Moe | 62/388 |
| 4,766,740 | 8/1988 | Bradley et al. | 62/384 |
| 5,046,332 | 9/1991 | Herrmann et al. | 62/388 |
| 5,320,218 | 6/1994 | Yamashita et al. | 141/67 X |
| 5,390,785 | 2/1995 | Garric et al. | 206/213.1 |
| 5,454,407 | 10/1995 | Huza et al. | 141/10 |

FOREIGN PATENT DOCUMENTS

| | | | |
|---|---|---|---|
| 207205 | 3/1957 | Australia | 206/3 X |
| 1442384 | 7/1976 | United Kingdom | 206/3 X |

*Primary Examiner*—John M. Sollecito
*Assistant Examiner*—Steve Gravini
*Attorney, Agent, or Firm*—Reising, Ethington, Barnard & Perry

[57] ABSTRACT

A sealed storage container includes a large storage compartment and a smaller cartridge chamber near the bottom of the storage container for a carbon dioxide gas cartridge. The cartridge chamber communicates with the storage compartment via a piercing orifice mechanism. The mechanism pierces the carbon dioxide gas cartridge when the cartridge is loaded into the cartridge chamber and pushed into the piercing orifice by a closure plug. When the cartridge is pierced; the carbon dioxide gas flows into the storage compartment and displaces the air in the storage compartment. The displaced air is exhausted through a small exhaust orifice near the top of a side wall of the storage container. When a sufficient amount of air is displaced, the exhaust orifice is sealed with a pipe plug.

12 Claims, 1 Drawing Sheet

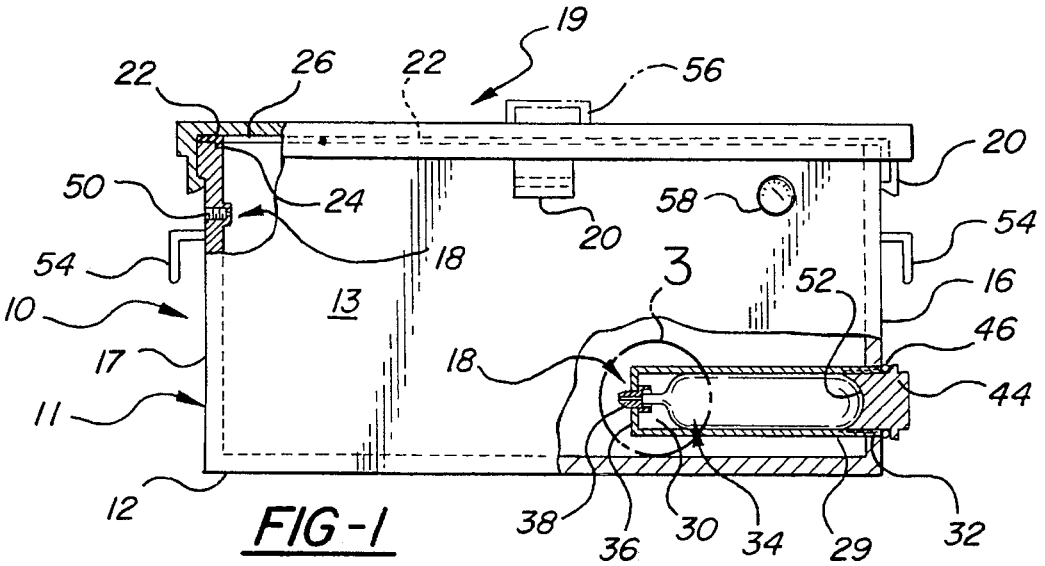
FIG-1
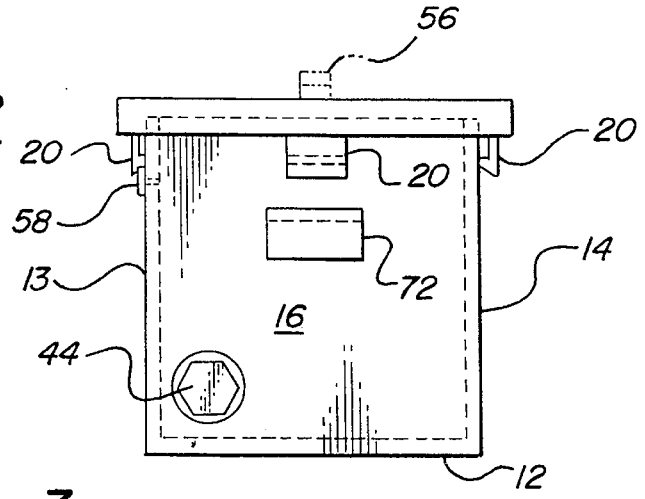
FIG-2
FIG-3
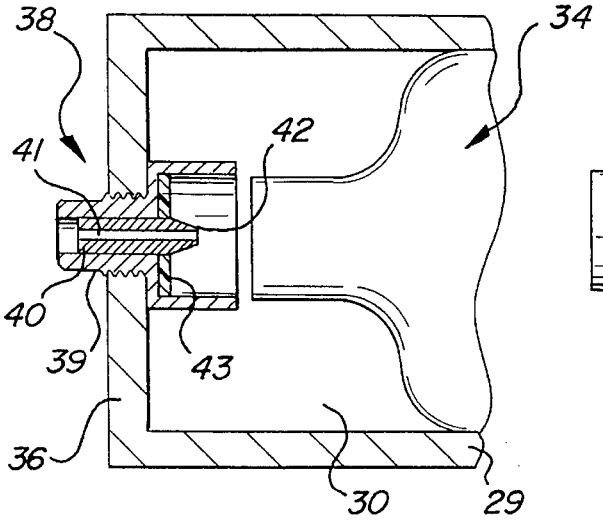
FIG-4
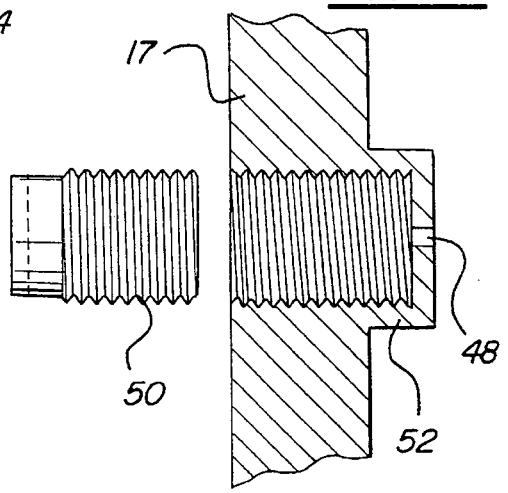

STORAGE CONTAINER WITH SEALED STORAGE COMPARTMENT FOR A PURGING GAS CARTRIDGE

BACKGROUND OF THE INVENTION

This invention relates generally to storage containers and more particularly to sealed storage containers for articles such as ammunition that are damaged by exposure to humidity for a long period of time.

SUMMARY OF THE INVENTION

The object of this invention is to provide a sealed storage container that protects the contents of the sealed storage container from damage due to humidity.

Another object of the invention is to provide a sealed storage container that provides long term storage of articles susceptible to damage from humidity.

A feature of the invention is that the sealed storage container is economical and durable.

Another feature of the invention is that the sealed storage container is dehumidified in a simple and economic manner.

Still another feature of the invention is that the sealed storage container uses readily available, inexpensive carbon dioxide gas cartridges to provide a low humidity environment for long term storage of articles susceptible to humidity damage.

BRIEF DESCRIPTION OF THE DRAWINGS

The above and other objects, features and advantages of the invention will become more apparent from the following description taken in conjunction with the accompanying drawings wherein like references refer to like parts and wherein:

FIG. 1 is a partially sectioned side view of a storage container in accordance with the invention;

FIG. 2 is an end view of the storage container shown in FIG. 1;

FIG. 3 is an enlarged fragmentary view of the storage container shown in FIG. 1; and FIG. 4 is another enlarged fragmentary view of the storage container shown in FIG. 1.

DESCRIPTION OF THE INVENTION

Referring now to the drawing, a sealed storage container in accordance with the invention is generally indicated at 10. The storage container 10 which is preferably portable comprises a rectangular housing 11 having a bottom wall 12, side walls 13 and 14 and end walls 16 and 17 which define a large storage compartment 18.

The storage container 10 further comprises a sealable lid or cover 19. The cover 19 can be formed as a separate member that is attached to the housing 11 by several latches 20 as shown in FIGS. 1 and 2. With this multiple latch arrangement, the cover 19 can be detached and lifted off the housing 11 completely. Alternatively, the cover 19 can be permanently attached to the housing 11 by a hinge at one end, for instance by replacing the right hand latch 20 shown in FIG. 1 with a hinge that is also connected to the end wall 16. With this hinge arrangement, the cover 19 can be pivoted from the closed position shown in FIGS. 1 and 2 to an open position (not shown) after the other three latches 20 are released. Thus the hinge arrangement still provides complete access to the storage compartment 18 when the cover 19 is opened. Moreover, the cover 19 is permanently attached to the housing 11 so that it is readily available for closure.

When the cover 19 is closed, the interface of the housing 11 and the cover 19 is sealed to prevent air or gas leaking into or out of the storage compartment 18 between the cover 19 and the housing 11. The cover seal arrangement in the embodiment shown in FIGS. 1 and 2 comprises a sealing member 22 that extends around the periphery of the housing 11. The sealing member 22 is disposed in a continuous groove 24 in the top of the side walls 13 and 14 and the end walls 16 and 17 so that it sealingly engages an interior surface 26 of the cover 19 and the groove 24 when the cover 19 is closed and latched down. The sealing member 22 is preferably an elastomeric O-ring of natural or synthetic rubber that is corrosion resistent. However, other suitable sealing members may be used.

One lower corner of the housing 11 is partitioned by a wall 29 to provide a small cartridge chamber 30 that has an access opening 32 in the end wall 16. The cartridge chamber 30 which is preferably shaped as a cylinder receives a carbon dioxide gas cartridge 34. The partition wall 29 for the cartridge chamber 30 includes an interior end wall 36 that supports a piercing orifice mechanism 38 that is shown in detail in FIG. 3. The piercing orifice mechanism 38 comprises a collar 39 that is screwed into a threaded hole in the end wall 36. The collar 39 holds a pin 40 that protrudes into a socket portion of the collar 39 that is located in the cartridge chamber 30. The pin 40 has a small orifice 41, for example an orifice of 0.020 inches, that extends through the pin 40 to establish communication between the storage compartment 18 and the cartridge chamber 30 and to provide an inlet orifice into the storage chamber 18. The protruding portion of the pin 40 is conical and it has a sharp edge 42 surrounding the orifice 40 for piercing the end of the gas cartridge 34. The protruding portion of the pin 40 also extends through a seal washer 43.

The access opening 32 for the cartridge chamber 30 is threaded and closed by a threaded access plug 44. The access plug 44 has a head which is hexagonal or otherwise suitably shaped for screwing the threaded plug 44 into the access opening 32. The shank end of the threaded plug 44 is preferably concave to match the bottom of the carbon dioxide gas cartridge 34. The threaded plug 44 also preferably has a circular sealing flange that presses an O-ring seal 46 against the end wall 16 to seal the access opening 32 when it is closed by the threaded plug 44. The O-ring seal 46 may be disposed in a shallow recess in the end wall 16 (not shown).

The storage container 10 further comprises an orifice 48 that serves as an exhaust or vent for the storage chamber 18 when it is sealed. The exhaust orifice 48 is also on the order of 0.020 inches. The exhaust orifice 48 is located in the upper part of the end wall 17 of the housing 11 that is opposite the end wall 16 which has the access opening 32 for the cartridge chamber 30. The exhaust orifice 48 may be located on either of the side walls 13 or 14 or either of the end walls 16 or 17. However, the exhaust orifice 48 is preferably located as close to the top of the wall as possible and may even be located in cover 19.

The storage container 10 also includes a seal plug 50 to close and seal off the exhaust orifice 48. The exhaust orifice 40 is located preferably in the inner end wall of a threaded recess 52 as best shown in FIG. 4 so that the seal plug 50 does not protrude outwardly of the end wall 17 when the exhaust orifice 48 is sealed off. The seal plug 50 can be an ordinary pipe plug that is slightly tapered so that the threads of the plug 50 sealingly engage the threads of the recess 52 when the plug 50 is screwed into the recess 52. The exterior end of the seal plug 50 has a screw driver slot or other suitable structure, such as a hex socket in order to screw the seal plug 50 into the recess 52.

The storage container 10 may be equipped with handles 54 on the end walls 16 and 17 to facilitate carrying the portable storage container 10. The cover 19 may also be equipped with a handle 56 to facilitate opening the storage container. However, the handles 54 and 56 are optional. In fact, the storage container 10 is preferably shaped to be stackable so that it may be necessary to eliminate the top handle 56 and possibly one or more of the side handles 54.

The storage container 10 operates in the following manner. The cover 19 is opened and storage articles such as ammunition are placed in the storage compartment 18. The cover 19 is then closed and latched down so that the storage compartment 18 is sealed. A carbon dioxide gas cartridge 34 is then loaded into the cartridge chamber 30 as shown in FIG. 3. The access opening 32 is then closed by the threaded plug 44. As the plug 44 is tightened down, the gas cartridge 34 is pushed into the piercing orifice mechanism 38 as shown in FIG. 1. This punctures the necked end of the gas cartridge 34 so that the compressed carbon dioxide gas flows into the storage compartment 18 through the inlet orifice 41. Since the carbon dioxide gas is heavier than the air inside the storage compartment 18 the carbon dioxide gas displaces the air and moisture entrapped in the air. The displaced air and moisture flow out the exhaust orifice 48. Eventually enough air and moisture are displaced so that the humidity level in the storage compartment 18 is at an acceptable level for the storage articles. This may require more than one carbon dioxide gas cartridge 34. If so a spent carbon dioxide gas cartridge is easily replaced by a fresh one simply by removing the access plug 44 and the spent cartridge, installing a fresh cartridge and reinstalling the threaded access plug 44. The cartridge chamber 30 is preferably isolated from the storage compartment 18 except for the inlet orifice 41 so that little if any carbon dioxide escapes when the gas cartridge is replaced. Moreover, the environment inside the storage compartment also does not deteriorate to any substantial degree when the gas cartridge is replaced due to the exhaust orifice 48 because the heavier carbon dioxide stays beneath the air and entrapped moisture and does not escape.

When the environment of the sealed storage compartment 18 reaches an acceptable level of humidity, the exhaust orifice 48 is sealed off by installing the seal plug 50. This may result in a slight pressure in the storage chamber 8 if the gas cartridge 34 in the cartridge chamber 30 is not spent. However this pressure can be relieved by manipulating the seal plug 50 and or removing the gas cartridge 34.

A humidity gauge 58 can be included to monitor the humidity in the storage compartment 18. However, a humidity gauge which can be expensive is strictly optional.

The housing 11 and cover 19 are preferably made of a durable corrosion resistent material and may be economically manufactured of molded plastic material. Moreover, the thickness of the housing walls and the cover can be varied to meet the particular needs of the articles being stored.

The carbon dioxide gas cartridges are commercially available and relatively inexpensive. For instance, a "POWERLET"™ carbon dioxide gas cartridge available from Crossman Air Guns may be used.

By way of example, I have found that it takes three Powerlet twelve (12) gram size carbon dioxide gas cartridges to properly condition a storage box that is about eleven (11) inches by seven (7) inches by (5) inches and that has piercing and exhaust orifices of about 0.020 inches. The first two cartridges are run for approximately five (5) minutes each and the third cartridge is run for approximately four and a half (4½) minutes. This procedure produces a virtually humidity free environment at a gas pressure of 2–3 pounds per square inch (psi) inside the storage container 10. As indicated above, this gas pressure may be relieved. However it is not necessary to do so. Of course, the number of carbon dioxide gas cartridges 34 that are necessary and the time that each is used will vary depending upon the size of the gas cartridge 34, the size of the storage container 10, the sizes of the piercing orifice 41 and the exhaust orifice 48, and the acceptable humidity level inside the storage container.

Thus the present invention provides a simple, economical and durable storage container for storing articles for long periods of time in a low or humidity free environment.

The invention has been described in an illustrative manner, and it is to be understood that the terminology which has been used is intended to be in the nature of words of description rather than of limitation.

Obviously, many modifications and variations of the present invention in light of the above teachings may be made. It is, therefore, to be understood that, within the scope of the appended claims, the invention may be practiced otherwise than as specifically described.

The invention claimed is:

1. A sealed storage container for storing articles in a low humidity environment comprising, a housing and a cover that is attachable to the housing to form a sealed storage compartment for storing items in a low humidity environment, the sealed storage compartment being partitioned to provide a cartridge chamber that has an access opening for insertion of a gas cartridge, a piercing orifice mechanism supported on a partition wall of the cartridge chamber to provide an inlet orifice into the storage compartment, an access plug removeably disposed in the access opening of the cartridge chamber, the storage container having an exhaust orifice for the storage compartment, and a removable seal plug for sealing the exhaust orifice.

2. The sealed storage container as defined in claim 1 wherein the piercing orifice mechanism is located at an inner end wall of the cartridge chamber.

3. The sealed storage chamber as defined in claim 2 wherein the access plug that is removable disposed in the access opening of the cartridge chamber is operative to push a gas cartridge against the piercing orifice mechanism so as to puncture the gas cartridge and allow compressed gas to be released from the cartridge into the storage compartment.

4. The sealed storage container as defined in claim 1 wherein the housing is rectangular and the cartridge chamber is located in a lower corner of the housing.

5. The sealed storage container as defined in claim 4 wherein the exhaust orifice is located at an upper portion of a side wall of the housing.

6. The sealed storage container as defined in claim 5 wherein the cartridge chamber is isolated from the storage compartment except for the orifice inlet.

7. The sealed storage chamber as defined in claim 5 wherein the exhaust orifice is located in an interior end of a recessed portion of the side wall.

8. A sealed storage container for storing articles in a low humidity environment comprising, a housing and a cover that is attachable to the housing to form a sealed storage compartment for storing articles in a low humidity environment, the housing having a cartridge chamber and at least one partition wall that is common to the cartridge compartment and the sealed storage chamber, a piercing orifice mechanism supported on the partition wall to provide a piercing edge in the cartridge chamber and an orifice inlet into the storage compartment, the housing having an exterior wall that has a threaded access opening for insertion of a gas cartridge into the cartridge chamber, a threaded access plug removeably disposed in the access opening of the cartridge chamber and operative to push a gas cartridge into the sharp edge to allow the release of compressed gas into the storage compartment via the inlet orifice, the storage container having an exhaust orifice for the storage compartment located in a threaded portion of the storage container, and a threaded seal plug removeably attached to the sealed container for sealing the exhaust orifice.

9. The sealed storage container as defined in claim 8 wherein the cartridge chamber is isolated from the storage compartment except for the orifice inlet.

10. The sealed storage container as defined in claim 9 wherein the housing is rectangular and the cartridge chamber is located in a lower corner of the housing.

11. The sealed storage container as defined in claim 10 wherein the exhaust orifice is located at an upper portion of a side wall of the housing.

12. The sealed storage chamber as defined in claim 11 wherein the exhaust orifice is located at an interior end of a recessed portion of the side wall.

* * * * *